United States Patent [19]

Tatham

[11] Patent Number: 4,884,369

[45] Date of Patent: Dec. 5, 1989

[54] SLIDING DOOR CLOSER

[76] Inventor: Gerald F. Tatham, 1391 W. Shaw Ave., Fresno, Calif. 93711

[21] Appl. No.: 332,522

[22] Filed: Mar. 31, 1989

[51] Int. Cl.[4] ..... E05D 15/06; E05F 1/00

[52] U.S. Cl. ..... 49/404; 16/81

[58] Field of Search ..... 49/404, 387; 16/81

[56] References Cited

U.S. PATENT DOCUMENTS

| | | | |
|---|---|---|---|
| 3,334,444 | 8/1967 | Hargrove | 49/387 X |
| 4,003,102 | 1/1977 | Hawks et al. | 49/404 X |
| 4,649,598 | 3/1987 | Kinsey et al. | 49/387 X |

*Primary Examiner*—Philip C. Kannan

*Attorney, Agent, or Firm*—Kimble, MacMichael & Upton

[57] ABSTRACT

An automatic door or window closing device which includes a tube attached to the edge of a moveable door or window. The tube has a weight displaced therein with a cable attached at the top which passes out of the top of the tube across a pulley and is connected to the door or window jam. A pneumatic seal is provided between the weight and the inside wall of the tube and works in conjunction with a port and valve at the bottom of the tube for controlling the flow of air passing therethrough. When the door or window is opened, the weight rises in the tube. When the door or window is released, the weight drops in the tube according to the adjustment of the port and valve at the bottom of the tube, until the door or window is completely closed.

5 Claims, 3 Drawing Sheets

SLIDING DOOR CLOSER

BACKGROUND OF THE INVENTION

The present invention relates to sliding door and window closing mechanisms. In recent years, sliding doors and windows have come into great usage in hotels, homes and office buildings. At the same time, the cost of the energy needed to heat and/or cool such buildings has increased dramatically. Because large amounts of heated or cooled air may escape from a sliding door or window which has been left open, there is a great need for a simple automatic door and window closing mechanism.

Various door closing mechanisms are known in the prior art including U.S. Pat. Nos. 4,649,598, 4,003,102, 3,334,444, 4,126,912, 4,004,372, 4,301,623, and 3,978,617. Of these, No. 4,649,598 (Kiney) and No. 3,334,444 (Hargrove) appear most pertinent. Both Kinsey and Hargrove disclose door closing mechanisms utilizing a cylindrical tube having a weight disposed therein which is connected to a cable which passes across a pulley which is attached to an anchor in the door jamb. Each of these door closing mechanisms utilizes a port or valve means at the bottom of the cylindrical tube to control the flow of air passing therethrough. In addition, the Kinsey door closer includes a valve means built into the top part of the weight so as to control the flow of air at the top of the weight, as well as the bottom of the tube. The specific function of the Kinsey valve is to allow air to escape when the door is closed quickly.

Hargrove discloses an air regulation valve at the bottom of the cylinder in which the weight is disposed. The weight itself is very close to the same diameter as the tube. By adjusting the valve at the bottom of the tube, the speed at which the weight drops within the cylinder may be controlled.

Both Kinsey and Hargrove suffer from numerous drawbacks. Most notably, neither provide for an efficient control of the column of air disposed within the tube below the weight and above the port means. Although Kinsey describes the pneumatic seal, a feature notably absent from Hagrove, this seal is part of the valve means at the top (not bottom) of the weight. This particular valve is virtually unnecessary and has been eliminated from the present invention. Moreover, a pneumatic seal is provided in the present invention as a modified O-ring around the weight intermediate its ends, at a location near the bottom of the weight itself.

It is therefore an object of the present invention to provide an automatic door and/or window closing device which includes a weight disposed within a cylindrical tube connected at the top to a cabling means which passes across a pulley and is mounted to the door header. At the bottom of the weight a pneumatic seal is provided which prevents the flow of air from passing from below the weight into the tube above it. A port means having a valve attached thereto is provided at the bottom of the tube to provide adjustable restriction on the air passing therethrough.

DETAILED DESCRIPTION OF THE DRAWINGS

No attempt is made to show structural details of the invention in more detail than is necessary for a fundamental understanding of the invention, the description taken with the drawings making apparent to those skilled in the art how the several forms of the invention may be embodied in practice.

Figure 1:
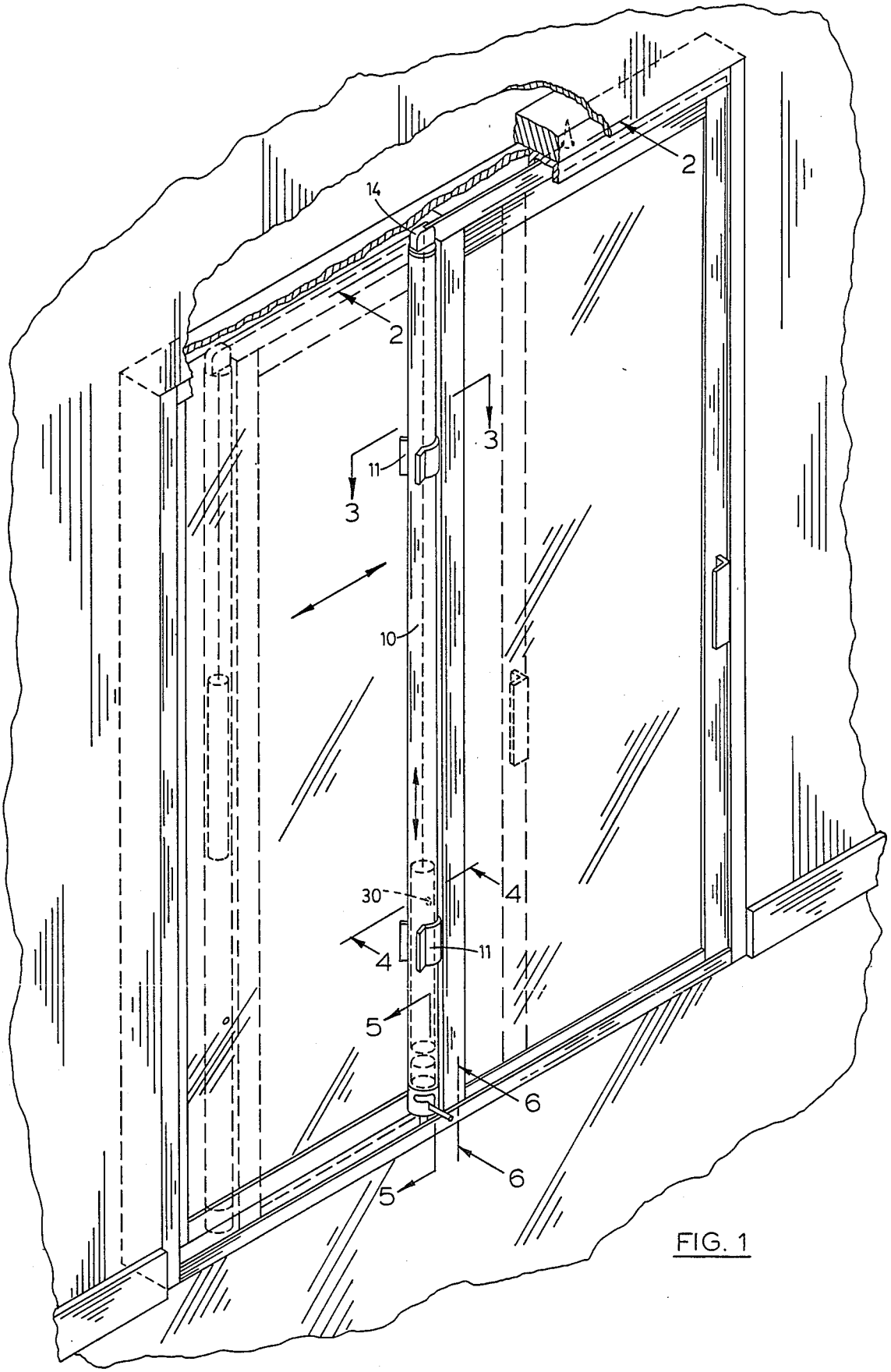
FIG. 1 is a perspective environmental view of the invention in place on a sliding glass door.
Figure 2:
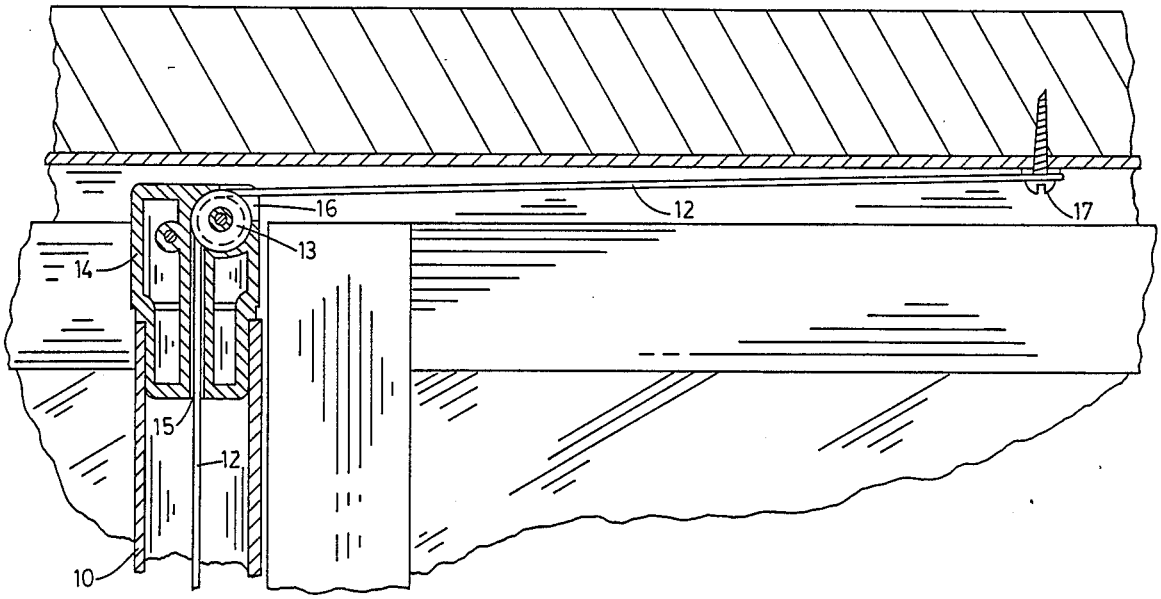
FIG. 2 is a cutaway view of the upper portion of the invention along lines 2—2.
Figure 3:
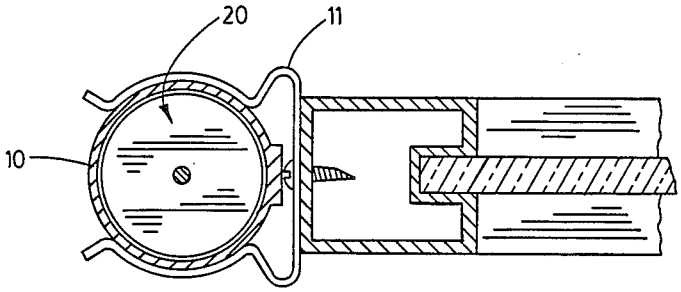
FIG. 3 is a cutaway view of the invention along line 3—3.

Like reference characters throughout the several views of the invention refer to the same features. With reference to FIG. 1, it can be seen that the present invention is comprised of a hollow cylindrical tube 10 which may be attached by use of clamp means 11 to the side of a moveable door or window. Detail of the clamp means is shown in FIG. 3. A pulley means 13 is mounted in the top of tube 10 by way of a special guide and plug adapter 14. This adapter provides a central bore 15 extending into the hollow tube 10 through which cable means 12 may pass into the adapter. The cable means stretches across pulley 13 and exits through gap 16 out of the top of the adapter. The cable may then be attached to the door header by attachment means 17.

Disposed within the tube is a weight 20 enclosed in a casing 21. Additional weighted material may be added in void region 24 to increase the amount of weight. Separately molded mounting pieces 22 and 23 are located, respectively, at the top and bottom of weight 20. The upper mounting piece 22 has disposed therein a hook means 25 to which cable means 12 may be attached. A circumfrential notch 27 is provided in upper mounting piece 22, and a flexible O-ring 26 is placed in said notch to hold the weight means away from the interior wall of the tube 10. An air escape valve 30 is provided in the lower portion of tube 10.

The bottom mounting piece 23 has a similar circumfrential notch 28 within which a pneumatic seal 29 is disposed. The seal comes in direct contact with the interior wall of tube 10 and blocks air from traveling from below said pneumatic seal as the weight descends within the tube. However, because of the deflection design of pneumatic seal 29, when the weight rises in the tube, air may pass from above the weight to below it across the pneumatic seal.

A plug means 35 is provided at the bottom of tube 10. Said plug means has a wide axial bore 36 cut therein in its upper portion, and a more narrow axial bore 37 at the bottom. The valve means 38 (in this case a ball) is disposed within axial bore 36. Said valve prevents air from flowing out through bore 37 while the weight is descending; however, it allows air to enter through bore 37 when the weight is ascending.

Bisecting axial bore 36 is a transverse bore 40 having a screw means 41 dispose therein. By adjusting the screw, the rate of the flow of air through bore 36 and out through bore 40 may be controlled. Said screw means 41 also keeps valve means 38 from exiting the axial bore 36.

Also disposed within plug means 35 is a stopping means 42 having a rubber foot 43 attached thereto.

Figure 6:
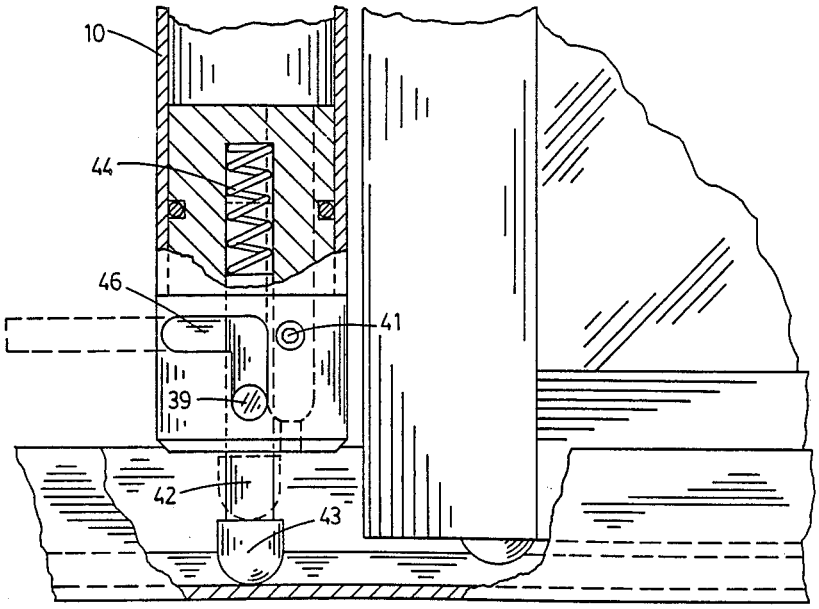
FIG. 6 is a cutaway view of the bottom portion of the invention along line 6—6.
Figure 4:
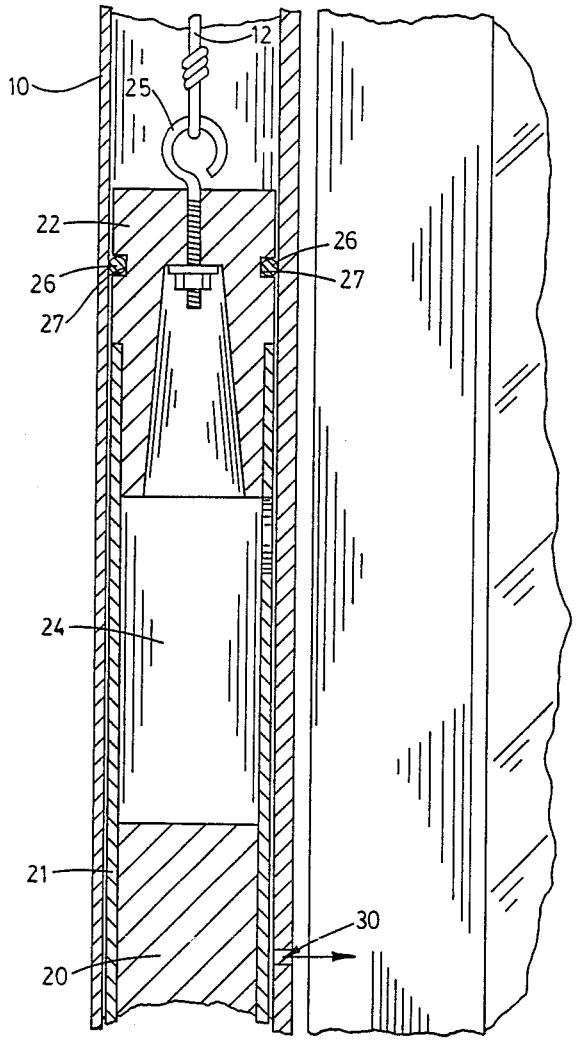
FIG. 4 is a cutaway view of the invention along line 4—4.
Figure 5:
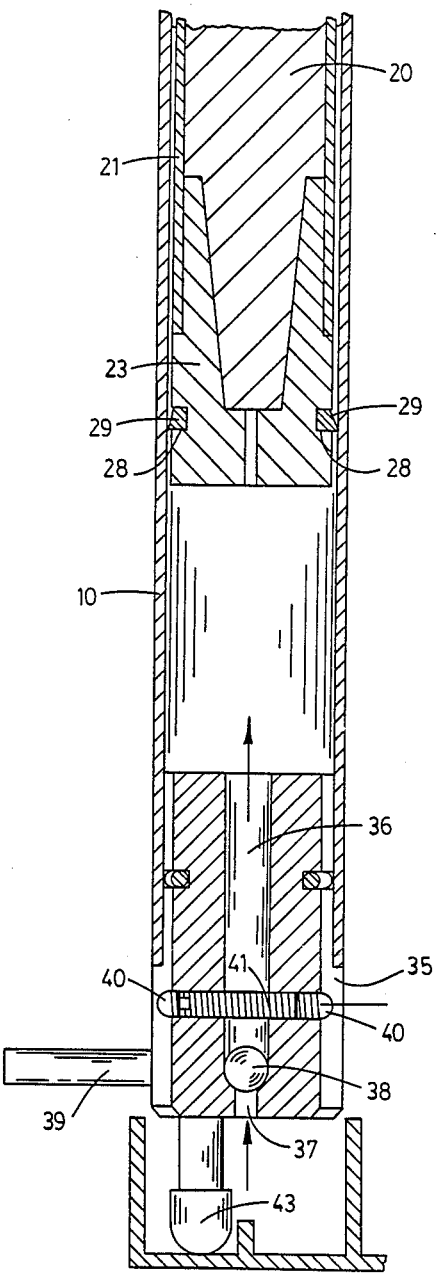
FIG. 5 is a longitudinal cutaway view of the invention along line 5—5.

Spring means 44 holds foot means 42 against the ground in the unlocked position. Handle means 39 allows the user to pull foot means 42 away from the ground and lock it into gap 46 so as to hold rubber foot 43 away from the ground as shown in FIG. 6.

DESCRIPTION OF THE PREFERRED EMBODIMENT

In operation, the automatic door or window closing mechanism of the present invention is attached to the outer edge of the sliding door or window. The invention consists of a cylindrical tube 10 having a weight 20 disposed therein, the top of which is attached to a cable 12 which passes across a pulley 13 at the top of the tube, and is fastened to the door header. The pneumatic seal 29 provided near the bottom of the weight works in conjunction with the port means 41 at the bottom of the tube. When the door is open, the weight is pulled upward in the tube. As it does so, the tapered pneumatic seal 29 allows air to pass along the sides of the weight into the portion of the tube below the weight. When the door is released, the weight drops causing the pneumatic seal to be formed. At this point, the only means for air to escape is through the air escape valve 30, and the variable restrictive valve 41 portion of the port at the bottom of the tube. The weight falls at a constant rate until the pneumatic seal 29 falls below air escape valve 30. Thereafter, the only way air may escape from below the weight is through valve means 41. By adjusting the restriction of this valve, the speed at which the weight drops may be controlled. This will be the speed at which the door is closed.

No oil or graphite or other material is required to be disposed within the tube.

By providing a weight of sufficient mass, any door or window may be closed. A hollow interior portion of the weight 24 may be filled with material so as to allow the mass of the weight to be increased as necessary. Furthermore, if the user causes the door or window closing process to be stopped before full closure is achieved, and then allows closure to continue, the mechanism provided by the present invention will close the door regardless of the point at which the stop occurred. The same is true if the user causes the door to be closed faster than the port means will allow the weight to fall within the tube, because of air escape valve 30. As soon as the weight catches up to the position of the door, it will commence and/or complete closure.

The advantage of the present invention is in its simplicity. By controlling the column of air below the weight by use of the escape valve and port means, the rate at which the door closure is achieved may be easily controlled. By providing a weight of sufficient mass, any door may be fully closed regardless of how much or how little it is opened. No oil, graphite, or other material is required to be disposed within the interior of the tube.

While this invention has been described with a certain degree of particularity, it is manifest that many changes may be made in the details of construction in the arrangement of components without departing from the spirit and scope of the disclosure. It is understood that the invention is not limited to the embodiment set forth herein for purpose of exemplification, but is limited only by the scope of the attached claim or claims, including the full range of equivalency to which each element thereof is entitled.

What is claimed:

1. A door or window closing mechanism comprising:

(a) A hollow cylindrical tube;

(b) A weight disposed within said tube;

(c) A port means at the bottom of said tube;

(d) A pulley attached to the top of said tube;

(e) A cable means attached to the top of said weight stretched across said pully and attached in an appropriate location on the door or window header; and (f) A pneumatic seal provided on the lower portion of said weight intermediate its ends between the outer circumfrential surface of the weight, and the internal circumfrential area of the tube, said seal having a deformable tapered edge so that air may freely pass the weight as it is raised in the tube, but may not pass the weight as it drops in the tube.

2. The device described in claim 1 wherein an air escape valve is provided in the side of said tube near the bottom of said tube.

3. The device described in claim 2 wherein an O-ring bumper is provided near the top of said weight to restrict any lateral movement thereof within the tube.

4. The invention described in claim 3 wherein said port means includes a variable restrictive valve to control the flow of air passing from the interior of the tube to the outside atmosphere.

5. The invention described in claim 4 wherein a spring loaded stopping means having a rubber-ended foot is disposed within a housing located at the bottom of said tube, said housing also having said port and valve means separately disposed therein.

* * * * *